US007946276B2

(12) United States Patent
Pusch et al.

(10) Patent No.: US 7,946,276 B2
(45) Date of Patent: May 24, 2011

(54) PROTECTION DEVICE FOR A SOLENOID OPERATED VALVE ASSEMBLY

(75) Inventors: Thomas G. Pusch, Edwards, IL (US); David E. Martin, Dunlap, IL (US); David Y. Chang, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 509 days.

(21) Appl. No.: 12/079,982

(22) Filed: Mar. 31, 2008

(65) Prior Publication Data

US 2009/0242667 A1 Oct. 1, 2009

(51) Int. Cl.
*F02M 51/00* (2006.01)
*B05B 1/30* (2006.01)
*F02M 61/04* (2006.01)

(52) U.S. Cl. ..... 123/490; 123/472; 251/129.01

(58) Field of Classification Search ..... 123/490, 123/472; 251/129.01, 129.06, 129.15; 310/323.04, 310/323.05, 323.08, 323.09
See application file for complete search history.

(56) References Cited

U.S. PATENT DOCUMENTS 4,552,311 A * 11/1985 Casey ..... 239/585.4
5,244,180 A * 9/1993 Wakeman et al. ..... 251/129.16
6,157,277 A 12/2000 Bulgatz et al.
6,161,813 A 12/2000 Baumgartner et al.
6,367,769 B1 4/2002 Reiter
6,409,144 B1 6/2002 Inami
6,550,699 B2 * 4/2003 Nagai et al. ..... 239/585.1
6,619,617 B2 9/2003 Ricco et al.
6,772,965 B2 8/2004 Yildirim et al.
6,929,242 B2 8/2005 Kirsch et al.
6,978,949 B2 12/2005 Dallmeyer
7,028,928 B2 4/2006 Shinogle
7,048,209 B2 5/2006 Czimmek
7,053,741 B2 5/2006 Tojo et al.
7,309,031 B2 12/2007 Goto et al.
2002/0056768 A1 5/2002 Czimmek
2003/0155440 A1 8/2003 Reiter
2006/0131448 A1 6/2006 Canepa-Anson et al.
2007/0028869 A1 2/2007 Ibrahim et al.
2007/0085644 A1 4/2007 Asaka et al.

* cited by examiner

*Primary Examiner* — Hieu T Vo
(74) *Attorney, Agent, or Firm* — Jason A. Houser; Carl E. Myers

(57) ABSTRACT

A fuel injector is disclosed. The fuel injector includes an injector valve needle and a valve actuation assembly including a stator, an armature, and a valve, the valve in fluid communication with the injector valve needle. A stator protection device is positioned between the stator and at least a portion of the armature. The stator protection device is configured to prevent contact between the stator and the armature.

19 Claims, 5 Drawing Sheets

PROTECTION DEVICE FOR A SOLENOID OPERATED VALVE ASSEMBLY

TECHNICAL FIELD

The present disclosure relates to a solenoid operated valve assembly, and, more particularly, to a protection device for a solenoid operated valve assembly.

BACKGROUND

Some engines use fuel injection systems to introduce fuel into the combustion chambers and/or a regeneration system of the engine. The fuel injection system may be any one of various types of fuel systems and may include, within the system, a number of fuel injectors. Among the various valves controlling the flow of fuel, a fuel injector may include at least one solenoid operated valve assembly. A solenoid operated valve assembly may include a solenoid and an associated valve. The solenoid may include a solenoid coil, a stator that acts as a magnet when the solenoid coil is provided with current, an armature, and a biasing or return spring. The armature is movable relative to the stator to actuate the valve.

When the solenoid coil is provided with current, a toroidal field of magnetic flux develops causing the armature to move relative to the stator. For example, the armature moves towards the stator upon energization of the solenoid coil. Upon cessation of current supplied to the solenoid coil, the return spring returns the armature to the original position, e.g., away from the stator. A typical fuel injection system requires this energization of the solenoid coil and subsequent movements of the armature repeatedly, rapidly, and with sufficient force. Consequently, the armature may potentially contact the stator due to various reasons. Contact between the armature and the stator potentially may cause damage to the stator surface. This, in turn, may cause loss of solenoid force and may result in injector performance change.

U.S. Patent Application Publication No. 2007/0028869 (the '869 publication), published on Feb. 8, 2007 in the name of Ibrahim et al., discloses one example of a fuel injector including a solenoid operated valve assembly. The '869 publication discloses an armature that moves relative to a stator during operation of the valve assembly. In the assembly of the '869 publication, at least one washer is utilized proximate the stator to facilitate insulation of undesired magnetic flux distributions to other portions of the fuel injector. Although the washer in the assembly of the '869 publication is located adjacent the stator, it is not situated so as to protect the stator from any potential contact by the armature. Accordingly, contact between the armature and the stator may occur.

The disclosed protection device for a solenoid operated valve assembly is directed to improvements in the existing technology.

SUMMARY

In one aspect, the present disclosure is directed toward a fuel injector including an injector valve needle, a valve actuation assembly including a stator, an armature, and a valve, the valve being in fluid communication with the injector valve needle, and a stator protection device positioned between the stator and at least a portion of the armature, the stator protection device configured to prevent contact between the stator and the armature.

In another aspect, the present disclosure is directed toward a valve actuation assembly for a fuel injector, the valve actuation assembly including a stator, an actuator in electromagnetic communication with the stator, the actuator including an armature, a valve associated with the actuator, and a stator protection device positioned between the stator and at least a portion of the armature, the stator protection device configured to prevent contact between the stator and at least a portion of the armature.

In yet another aspect, the present disclosure is directed toward a machine including an engine configured to generate a power output and including at least one combustion chamber, a source of fuel, and a fuel injector configured to inject fuel into the at least one combustion chamber, the fuel injector including an injector valve needle, a valve actuation assembly including a stator, an armature, and a valve, the valve in fluid communication with the injector valve needle, and a stator protection device positioned between the stator and at least a portion of the armature, the stator protection device configured to prevent contact between the stator and the armature.

DETAILED DESCRIPTION

Figure 1:
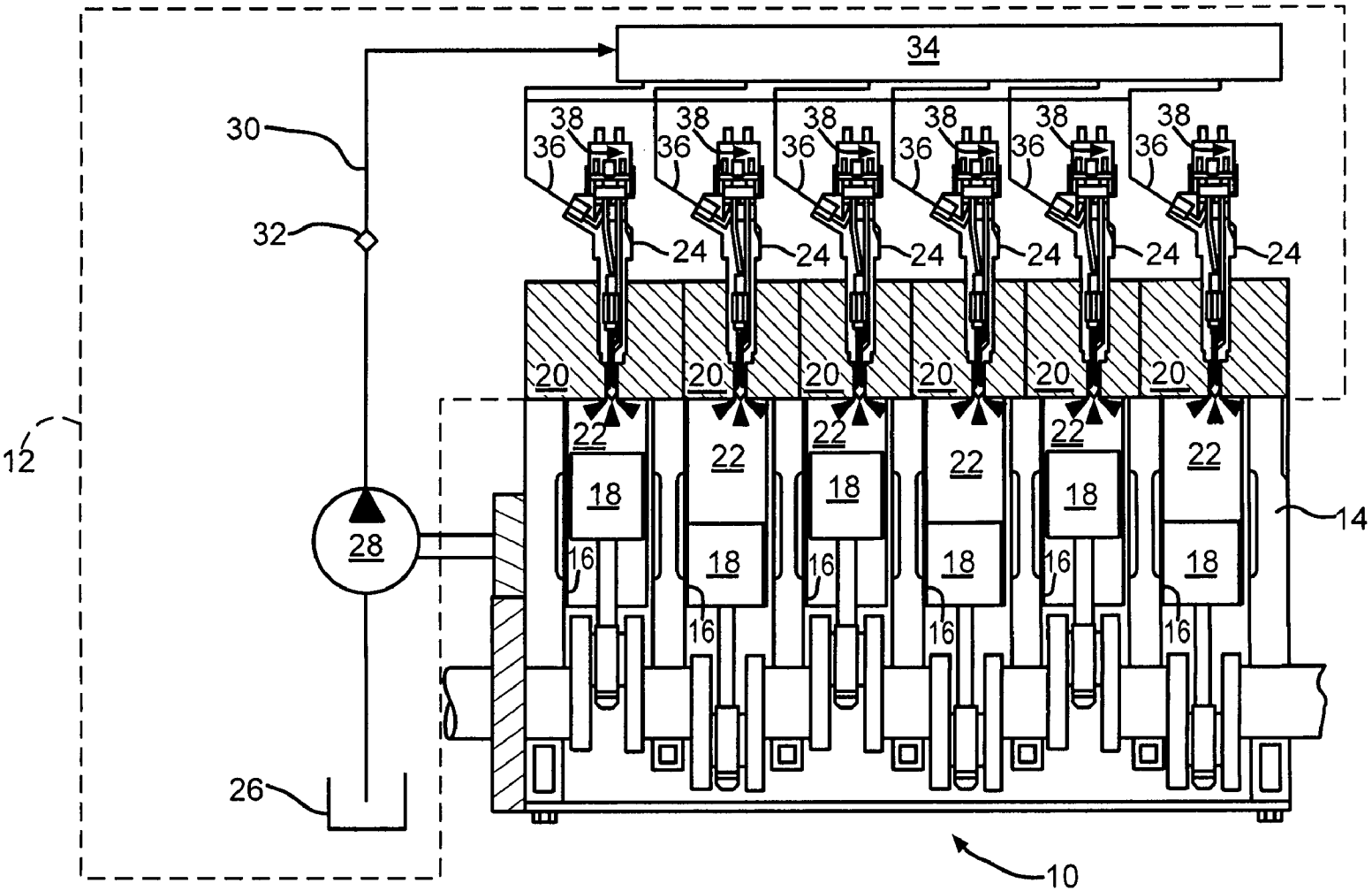
FIG. 1 is a schematic and diagrammatic illustration of an exemplary fuel injection system for an engine.

FIG. 1 diagrammatically illustrates an engine 10 with a fuel injection system 12. Engine 10 includes an engine block 14 that defines a plurality of cylinders 16, a piston 18 slidably disposed within each cylinder 16, and a cylinder head 20 associated with each cylinder 16. The cylinder 16, the piston 18, and the cylinder head 20 form a combustion chamber 22.

The fuel injection system 12 includes components that cooperate to deliver fuel to fuel injectors 24, which in turn deliver fuel into each combustion chamber 22. Specifically, the fuel injection system 12 includes a supply tank 26, a fuel pump 28, a fuel line 30 with a check valve 32, and a manifold or fuel rail 34. From the fuel rail 34, fuel is supplied to each fuel injector 24 through a fuel line 36. As shown, each fuel injector 24 includes one or more solenoid operated valve assemblies 38.

Figure 2:
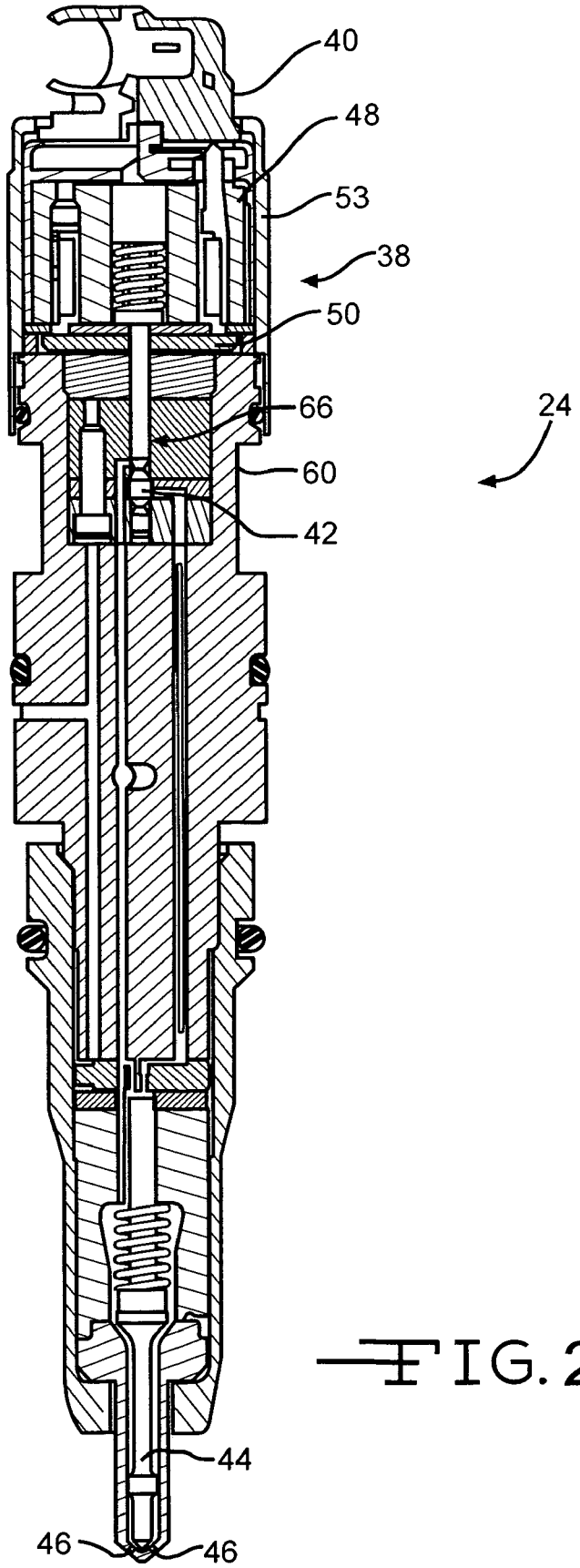
FIG. 2 is a cross-sectional view of an exemplary fuel injector of the fuel injection system of FIG. 1.

FIG. 2 is a cross-sectional view of an exemplary fuel injector 24. The illustrated fuel injector 24 includes a solenoid operated valve assembly 38. The solenoid operated valve assembly 38 includes a solenoid 40 and a valve element 42. The solenoid 40 controls the valve element 42 located in an injector body 60, which in turn controls the flow of fuel to an injector valve needle or check 44. The injector valve needle or check 44 cooperates with the orifices 46 to inject fuel into a combustion chamber 22 (FIG. 1).

Figure 3:
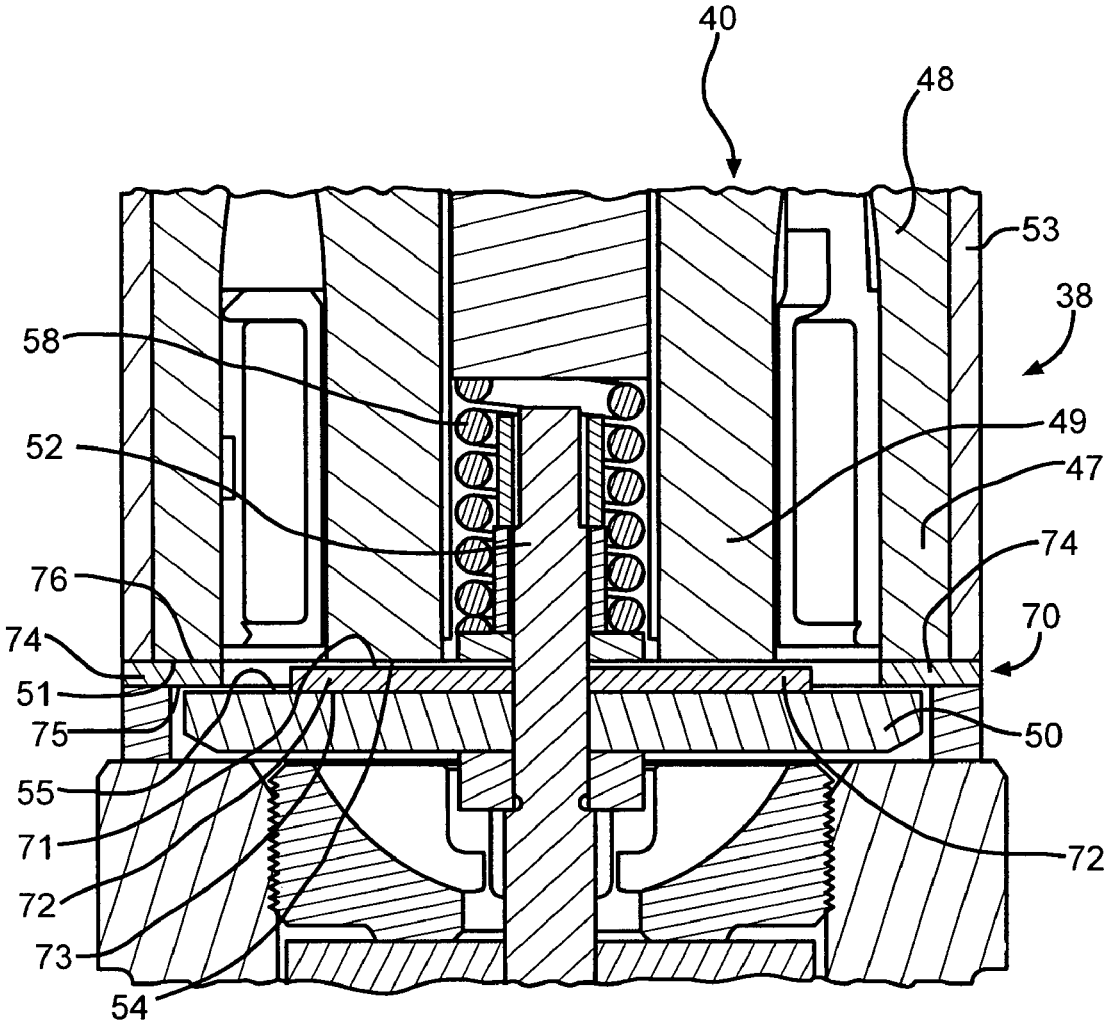
FIG. 3 is a partial cross-sectional view of a portion of the fuel injector of FIG. 2.

FIG. 3 is a partial cross-sectional illustration of relevant components of a solenoid operated valve assembly 38 that may be used, for example, in the fuel injector 24 of FIG. 2. The solenoid 40 has a solenoid coil, a stator 48, and an armature 50. The stator 48 is at least partially enclosed by a housing or solenoid case 53. The stator 48 includes a stator inner pole or portion 49 and a stator outer pole or portion 47. The stator 48 may be formed of a soft magnetic composite material (SMC), such as Somaloy® material, commercially available from Höganäs AB Corporation of Sweden (Somaloy® is a registered trademark of Höganäs AB Corporation), which includes compacted surface insulated iron powder particles. The particles are compacted to form uniform isotropic components with desired shapes. The SMC material of the stator 48 has magnetic properties such as high magnetic saturation and low eddy current loss. The strength of the material of the stator 48 is relatively low, especially under high operating temperatures. For example, the SMC material of the stator 48 may have a rupture strength of approximately 14.5 ksi (100 MPa).

When current is supplied to the solenoid coil, a magnetic field forms and the stator 48 acts as a magnet. Because the armature 50 is composed of a magnetically attractive material, for example, a ferromagnetic material, the armature 50 is moved under the influence of the stator 48. In FIG. 3, for example, the armature 50 is caused to move upwardly toward the stator 48 when current is supplied to the solenoid coil.

The solenoid operated valve assembly 38 includes a plunger 52. A biasing or return spring 58 is operable to move the armature 50 relative to the stator 48. Where, as illustrated here, the armature 50 and the plunger 52 moves under the influence of the magnet in an upward direction, the return spring 58 biases the armature 50 and the plunger 52 in the opposite, or downward (in FIG. 3), direction upon cessation of current to the solenoid coil. The solenoid 40 is connected to an injector body 60 of the fuel injector 24 (FIG. 2). The plunger 52 is connected to a valve member 66. Both the plunger 52 and the valve member 66 are secured to the armature 50. The valve element 42, the plunger 52, and the valve member 66 are formed having a one-piece construction and form a poppet valve or three-way valve for the fuel injector 24.

The solenoid operated valve assembly 38 also includes a stator protection device 70. The stator protection device 70 includes an inner pole 72 and an outer pole 74. In an exemplary embodiment, the inner pole 72 and the outer pole 74 are separate. The stator protection device 70 is formed of a material which is relatively harder and which possesses greater yield strength, e.g., less brittle, than the SMC material of the stator 48. Moreover, the material of the stator protection device 70 may have magnetic properties similar to those of the SMC material such as to maintain the magnetic properties of the solenoid 40. In an exemplary embodiment, the material of the stator protection device 70 may have relatively good magnetic properties.

In an exemplary embodiment, the stator protection device 70 is formed of a silicon core iron material, such as Carpenter Silicon Core Iron B-FM ("B-FM"), which is a machinable magnetic alloy formed in accordance with ASM Fe-116. The B-FM material has good magnetic permeability, which permits high magnetic flux density, and may be machined or compression molded to a desired shape. The B-FM material may include approximately 0.03% carbon, approximately 0.120% phosphorus, approximately 0.40% manganese, approximately 2.50% silicon, and the remainder formed of iron. In an exemplary embodiment, the B-FM material may have a tensile strength between approximately 80 ksi (552 MPa) and 85 ksi (586 MPa), a 0.2% yield strength of between approximately 65 ksi (448 MPa) and 70 ksi (483 MPa), and Rockwell B hardness value of between approximately 88 and 90.

The stator protection device 70 is positioned between the stator 48 and the armature 50 to prevent incidental contact between the armature 50 and the stator 48 during fuel injection activity. In FIG. 3, for example, the stator protection device 70 is formed as a two-piece, ring-shaped device having an inner pole 72 and an outer pole 74. The inner pole 72 is connected to the armature 50 and has a contact surface 71 which may abut a contact surface 54 of the stator inner pole 49 of the stator 48 and an opposite contact surface 73 abutting a contact surface 55 of the armature 50. The outer pole 74 has a contact surface 76 abutting a contact surface 51 of the stator outer pole 47 of the stator 48 and an opposite contact surface 75 which may abut the contact surface 55 of the armature 50.

In an exemplary embodiment, a distance from the contact surface 71 and the contact surface 73 of the inner pole 72 of the stator protection device 70, and from the contact surface 76 and the contact surface 75 of the outer pole 74 of the stator protection device 70, is approximately 0.5 millimeters (mm), 0.75 mm, 1 mm, 1.2 mm, 1.4 mm, 1.6 mm, 1.8 mm, or 2.0 mm. In an exemplary embodiment, thicknesses of the inner pole 72 defined between the contact surfaces 71 and 73 and the outer pole 74 defined between the contact surfaces 76 and 75 are substantially equal. A stator protection device 70 having such a thickness provides sufficient protection for the stator 48 from contact with the armature 50 while maximizing the reaction forces, e.g., force rise rate and force decay rate, provided by the stator 48. In one embodiment, such as the embodiment shown in FIG. 3, the outer pole 74 of the stator protection device 70 is welded to the solenoid case 53 and the inner pole 72 of the stator protection device 70 is attached to the armature 50 via a fastener arrangement. Other methods of attachment of the outer pole 74 of the stator protection device 70 to the stator 48 include, inter alia, press-fitting, bonding, knurl press-in, and mechanical fastening.

Figure 4:
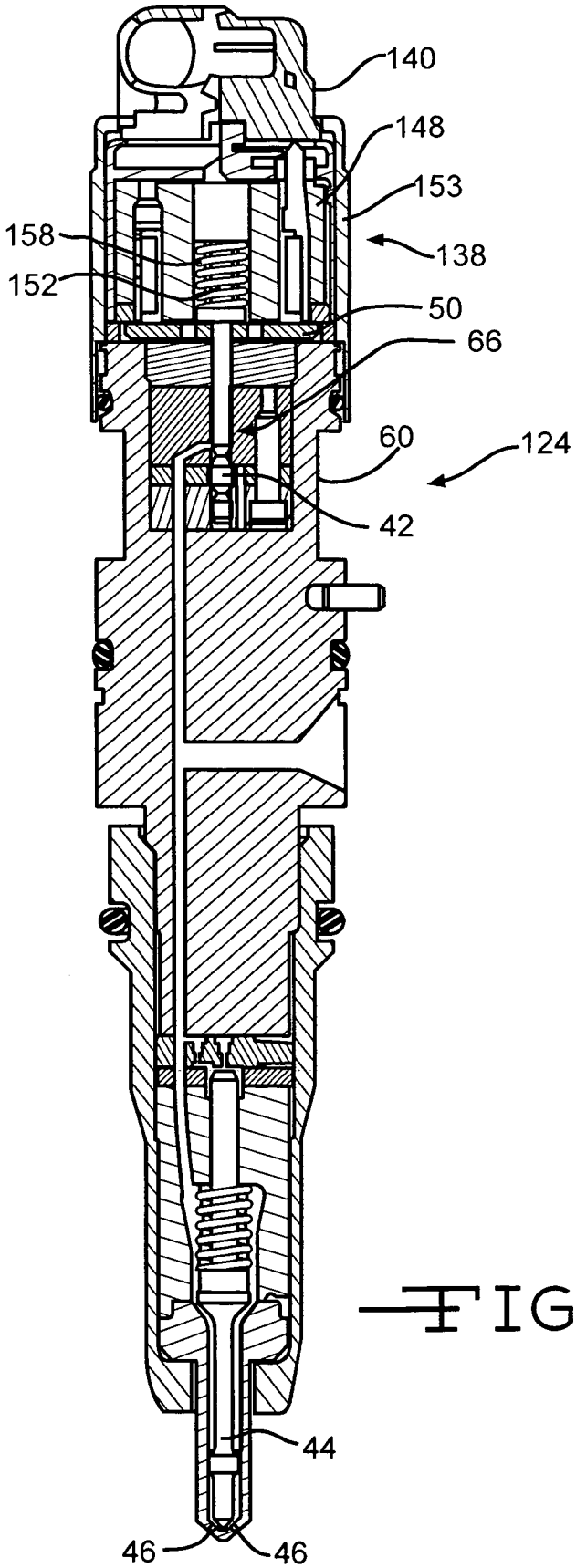
FIG. 4 is a cross-sectional view of another exemplary fuel injector of the fuel injection system of FIG. 1.
Figure 5:
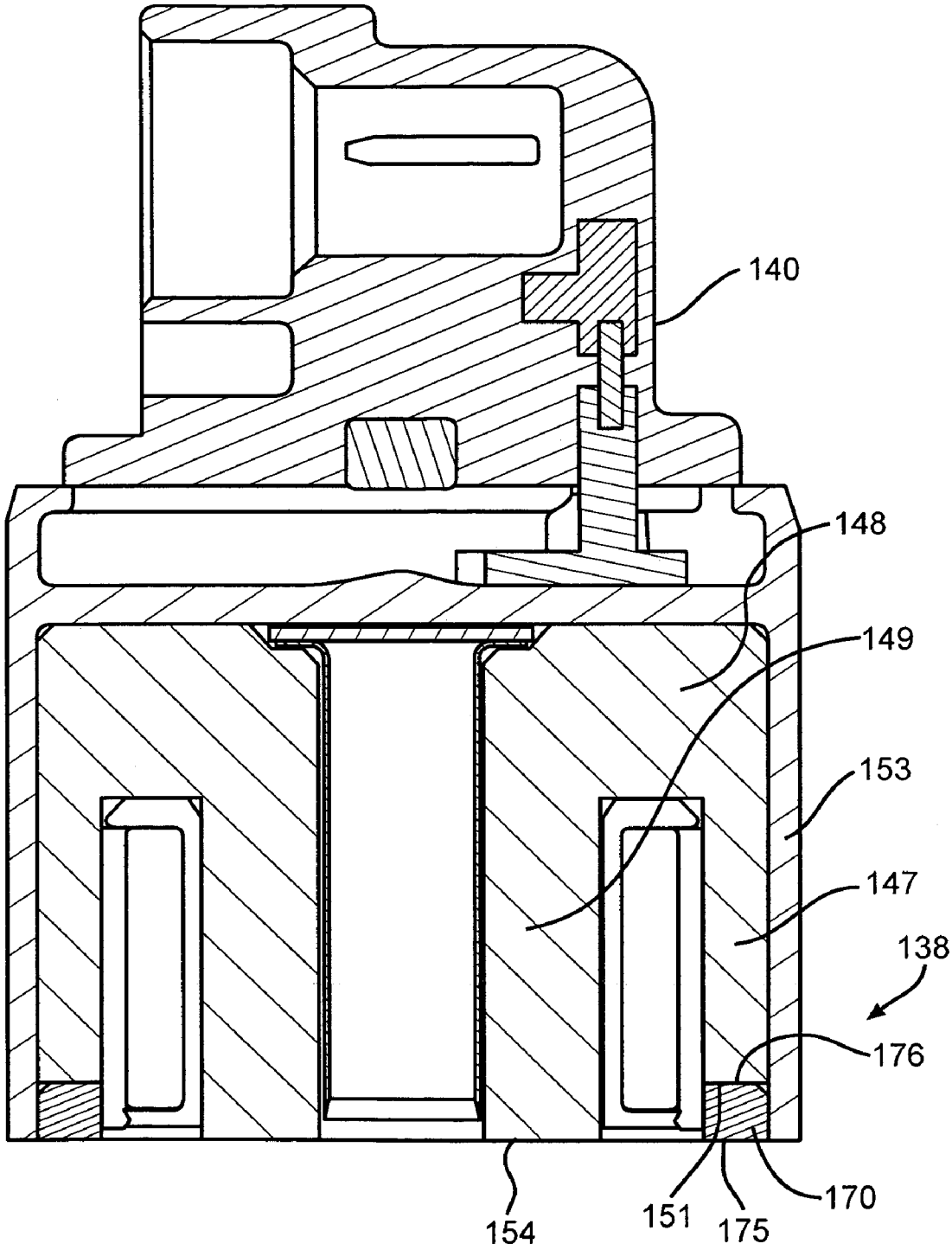
FIG. 5 is a partial cross-sectional view of a portion of the fuel injector of FIG. 4.

Referring now to FIGS. 4 and 5, another exemplary embodiment of a stator protection device is illustrated. As shown in FIG. 4, a fuel injector 124 includes many of the same components as the fuel injector 24, described above with reference to FIGS. 2 and 3, such as an armature 50, an injector body 60, a valve member 66, a valve element 42, an injector valve needle or check 44, and at least one orifice 46. The fuel injector 124 includes a solenoid operated valve assembly 138. The solenoid operated valve assembly 138 includes a solenoid 140 and the valve element 42. The solenoid 140 controls the valve element 42 located in the injector body 60, which in turn controls the flow of fuel to the injector valve needle or check 44. The injector valve needle 44 or check 44 cooperates with the orifices 46 to inject fuel into a combustion chamber 22 (FIG. 1).

FIG. 5 is a partial cross-sectional illustration of relevant components of the solenoid operated valve assembly 138 that may be used, for example, in a fuel injector 124 similar to that shown in FIG. 4. The solenoid 140 has a solenoid coil, a stator 148, and an armature 50. The stator 148 is at least partially enclosed by a housing or solenoid case 153. The stator 148 includes a stator inner pole 149 and a stator outer pole 147. The stator 148 is formed of a soft magnetic composite material (SMC), substantially similar to the material of the stator 48, described above with reference to FIG. 3.

When current is supplied to the solenoid coil, a magnetic field forms and the stator 148 becomes a magnet. Because the armature 50 is composed of a magnetically attractive material, for example, a ferromagnetic material, the armature 50 is moved under the influence of the stator 148. In FIG. 4, for example, the armature 50 is caused to move upwardly toward the stator 148 when current is supplied to the solenoid coil.

The solenoid operated valve assembly 138 includes a plunger 152 (FIG. 4). A biasing or return spring 158 (FIG. 4) is operable to move the armature 50 relative to the stator 148. Where, as illustrated here, the armature 50 and the plunger 152 are moved under the influence of the magnet in an upward direction, the return spring 158 biases the armature 50 and the plunger 152 in the opposite, or downward (in FIG. 4), direction upon cessation of current to the solenoid coil. The solenoid 140 is connected to the injector body 60 of the fuel injector 124 (FIG. 4). The plunger 152 is connected to a valve member 66. Both the plunger 152 and the valve member 66 are secured to the armature 50. The valve element 42, the plunger 152, and the valve member 66 are formed having a one-piece construction and form a poppet valve or three-way valve for the fuel injector 124.

The solenoid operated valve assembly 138 also includes a stator protection device 170. The stator protection device 170 is formed of a material which is relatively harder and which possesses greater yield strength, e.g., less brittle, than the SMC material of the stator 148. Moreover, the material of the stator protection device 170 may have magnetic properties similar to those of the SMC material. In an exemplary embodiment, the material of the stator protection device 170 may have relatively good magnetic properties. For example, the stator protection device 170 is formed of a material substantially similar to the material of the stator protection device 70, described above with reference to FIGS. 2 and 3.

The stator protection device 170 is positioned between the stator 148 and the armature 50 to prevent incidental contact between the armature 50 and the stator 148 during fuel injection activity. In FIGS. 4 and 5, for example, the stator protection device 170 is formed as a ring-shaped device having a contact surface 176 abutting a contact surface 151 of the stator outer pole 147 of the stator 148 and an opposite contact surface 175 which may abut the contact surface 55 (FIG. 3) of the armature 50. The stator inner pole 149 of the stator 148 includes a contact surface 154 adjacent the contact surface 55 (FIG. 3) of the armature 50. Although the stator protection device 170 is shown in FIG. 5 as protecting the stator outer pole 147 of the stator 148, the stator protection device 170 may be modified to protect both the stator inner pole 149 and the stator outer pole 147 of the stator 148, similar to the stator protection device 70, described above with reference to FIGS. 2 and 3. Similarly, the stator protection device 170 of FIGS. 4 and 5 may be used in the fuel injector 24 of FIGS. 2 and 3 and the stator protection device 70 of FIGS. 2 and 3 may be used in the fuel injector 124 of FIGS. 4 and 5.

In an exemplary embodiment, a distance from the contact surface 176 and the contact surface 175 of the stator protection device 170 is approximately 0.5 millimeters (mm), 0.75 mm, 1 mm, 1.2 mm, 1.4 mm, 1.6 mm, 1.8 mm, or 2.0 mm. A stator protection device 170 having such a thickness provides sufficient protection for the stator 148 from contact with the armature 50 while maximizing the reaction forces, e.g., force rise rate and force decay rate, provided by the stator 148. In one embodiment, such as the embodiment shown in FIGS. 4 and 5, the stator protection device 170 is attached to the solenoid 140 via welding, bonding, knurl press-in, and/or mechanical fastening. For example, the outer circumference of the stator protection device 170 may include a knurled surface which is pressed into the inner circumference of the solenoid case 153 which may optionally also include a knurled surface.

INDUSTRIAL APPLICABILITY

The disclosed protection devices may be applicable to any engine and/or machine utilizing a solenoid operated valve assembly, such as assemblies used in many types of fuel injectors.

In operation, when current is supplied to the solenoid coil, a magnetic field forms and the stator 48, 148 becomes a magnet, which consequently moves the armature 50 toward the stator 48, 148. Upon cessation of current supply to the solenoid coil, a return spring 58, 158 moves the armature 50 away from the stator 48, 148. Under these operating conditions, the armature 50 may potentially contact the stator 48, 148 during fuel injection activity. The stator protection device 70, 170 protects at least a portion of the stator 48, 148 by preventing contact between the stator 48, 148 and the armature 50 at least along an axis of movement of the armature 50. Consequently, the armature 50 is prevented from potentially contacting a portion of the stator 48, 148 and decreasing the efficiency of the solenoid 40, 140.

It will be apparent to those skilled in the art that various modifications and variations can be made to the disclosed protection devices without departing from the scope of the disclosure. Other embodiments of the protection devices will be apparent to those skilled in the art from consideration of the specification and practice of the protection devices disclosed herein. It is intended that the specification, illustrations, and examples be considered as exemplary only, with a true scope of the disclosure being indicated by the following claims and their equivalents.

What is claimed is:

1. A fuel injector, comprising:

an injector valve needle;

a valve actuation assembly including a stator having an inner stator portion, an armature, and a valve, the valve being in fluid communication with the injector valve needle;

a stator protection device positioned between the inner stator portion and at least a portion of the armature, the stator protection device configured to prevent contact between the inner stator portion and the armature.

2. The fuel injector of claim 1, further including a stator housing, wherein the stator protection device is welded to the stator housing.

3. The fuel injector of claim 1, wherein the stator protection device is engaged with the stator via a press-fit engagement.

4. The fuel injector of claim 1, wherein the stator further includes an outer stator portion, the stator protection device configured to prevent contact between at least the outer stator portion and the armature.

5. The fuel injector of claim 1, wherein the stator protection device includes a first contact surface and a second contact surface, the first contact surface and the second contact surface defining a thickness of the stator protection device of approximately 2 millimeters.

6. The fuel injector of claim 1, wherein the stator protection device has a relative higher strength than the stator.

7. The fuel injector of claim 1, wherein the stator protection device includes a silicon core iron material.

8. A valve actuation assembly for a fuel injector, the valve actuation assembly comprising:

a stator having an inner stator portion;

an actuator in electromagnetic communication with the stator, the actuator including an armature;

a valve associated with the actuator; and a stator protection device positioned between the inner stator portion and at least a portion of the armature, the stator protection device configured to prevent contact between the inner stator portion and at least a portion of the armature.

9. The valve actuation assembly of claim 8, further including a stator housing, wherein the stator protection device is welded to the stator housing.

10. The valve actuation assembly of claim 8, wherein the stator protection device is engaged with the stator via a press-fit engagement.

11. The valve actuation assembly of claim 8, wherein the stator further includes an outer stator portion, the stator protection device configured to prevent contact between at least the outer stator portion and the armature.

12. The valve actuation assembly of claim 8, wherein the stator protection device includes a first contact surface and a second contact surface, the first contact surface and the second contact surface defining a thickness of the stator protection device of approximately 2 millimeters.

13. The valve actuation assembly of claim 8, wherein the stator protection device includes a silicon core iron material.

14. A machine, comprising:

an engine configured to generate a power output and including at least one combustion chamber; and a fuel injector configured to inject fuel into the at least one combustion chamber, the fuel injector including:

an injector valve needle;

a valve actuation assembly including a stator having an inner stator portion, an armature, and a valve, the valve in fluid communication with the injector valve needle; and a stator protection device positioned between the inner stator portion and at least a portion of the armature, the stator protection device configured to prevent contact between the inner stator portion and the armature.

15. The machine of claim 14, further including a stator housing, wherein the stator protection device is welded to the stator housing.

16. The machine of claim 14, wherein the stator protection device is engaged with the stator via a press-fit engagement.

17. The machine of claim 14, wherein the stator further includes an outer stator portion, the stator protection device configured to prevent contact between at least the outer stator portion and the armature.

18. The machine of claim 14, wherein the stator protection device includes a first contact surface and a second contact surface, the first contact surface and the second contact surface defining a thickness of the stator protection device of approximately 2 millimeters.

19. The machine of claim 14, wherein the stator protection device includes a silicon core iron material.

* * * * *